United States Patent [19]

Owada et al.

[11] Patent Number: 4,841,330

[45] Date of Patent: Jun. 20, 1989

[54] RECORDING APPARATUS

[75] Inventors: Susumu Owada; Masayuki Kamegamori, both of Hachioji; Akira Kosugi, Hino, all of Japan

[73] Assignee: Konishiroku Photo Industry Co., Ltd., Tokyo, Japan

[21] Appl. No.: 22,209

[22] Filed: Mar. 5, 1987

[30] Foreign Application Priority Data

| | | | |
|---|---|---|---|
| Mar. 8, 1986 | [JP] | Japan | 61-50982 |
| Mar. 8, 1986 | [JP] | Japan | 61-50984 |
| Mar. 8, 1986 | [JP] | Japan | 61-33504[U] |
| Mar. 11, 1986 | [JP] | Japan | 61-51312 |

[51] Int. Cl.[4] ..... G03G 15/06

[52] U.S. Cl. ..... 355/245

[58] Field of Search ..... 355/3 DD, 4; 118/653, 118/657, 658

[56] References Cited

U.S. PATENT DOCUMENTS

| | | | |
|---|---|---|---|
| 3,480,359 | 11/1969 | Lawes et al. | 355/3 DD |
| 3,599,604 | 8/1971 | Chawda et al. | 355/3 DD |
| 3,976,371 | 8/1976 | Moser et al. | 355/3 DD |
| 4,391,503 | 7/1983 | Pugh | 355/3 DD |
| 4,583,832 | 4/1986 | Kasamura et al. | 355/3 DD |

*Primary Examiner*—Fred L. Braun

*Attorney, Agent, or Firm*—Finnegan, Henderson, Farabow, Garrett and Dunner

[57] ABSTRACT

A recording apparatus that includes an image carrier that has a movable image surface adapted for carrying a latent image to be developed. The apparatus further includes a developing unit that has a developer surface for conveying a developer thereon. A guide member is provided for slidably mounting the developing unit thereon. Biasing elements are included for releasably biasing the developing unit between at least two positions. The first position is a biased position wherein the developer surface faces the movable image with a development gap therebetween to transfer the developer onto the latent image. The second position is a released position wherein the developer surface is spaced from the movable image surface with a gap larger than the development gap. The guide member allows the developing unit to further slide in a direction transverse to the biasing direction.

12 Claims, 6 Drawing Sheets

RECORDING APPARATUS

FIELD OF THE INVENTION

The present invention relates to a recording apparatus such as a copying machine and, more particularly, to a structure for mounting a developing unit in the frame of the copying machine.

BACKGROUND OF THE INVENTION

It is known in an electrophotographic copying machine to mount one or the other of an image carrying drum and a developing unit so that it may be removed from the copying machine through movement in the longitudinal direction of the image carrying drum. Either the drum or the developing unit is designed to be removable to simplify assembly of the machine during manufacturing and to make it easier to repair and maintain the machine.

In an electrophotographic copying machine, the developing unit is mounted in a frame at a position adjacent to the image carrying drum. The developing unit is provided with a developing roller for carrying developer to the developing zone so that an electrostatic latent image formed on the image carrying drum may be developed to form a toner image. A matching roller is mounted on the shaft of the developing roller and is brought into engagement with the image carrying drum to establish a predetermined gap between the photosensitive drum and the developing roller.

Running the steps of removing the developing unit from the body of the copying machine for maintenance, there arises a problem of damaging the surface of the image carrying drum by the matching roller engaging the drum. In high speed electrophotographic copying machines, the thickness of the ear of the developer formed on the surface of the developing sleeve of the developing unit, that is, the gap between the outer surface of the image carrying drum and that of the developing sleeve, is set to a value of about 0.5 1.00 mm. Thus, even for machines that have no matching roller, the surface of the developing sleeve of the developing unit often contacts the surface of the image carrying drum at the time of mounting or dismounting the developing unit on, or from, the machine frame and damages the expensive image carrying drum. Another problem is that the ear of the developer magnetically attracted to the surface of the developing sleeve rubs against the surface of the drum and the toner drops outside the machine causing environmental pollution.

In order to solve the above problems, a downwardly inclined rail has been arranged within the machine frame and the developing unit is mounted on, or dismounted from, the machine frame along the rail.

This structure is not without problems in that the equipment surrounding the copying machine must be removed when mounting or dismounting the developing unit, requiring increased labor and time for maintenance and control of the machine as well as during assembly during manufacture.

OBJECTS AND SUMMARY OF THE INVENTION

Thus, in view of the above-mentioned problems of conventional developing unit mounting structures, an object of the present invention is a recording apparatus having a developing unit mounting structure for a copying machine with which maintenance and assembly can be performed in a simple manner.

Another object of the present invention is a recording apparatus having a developing unit mounting structure which does not damage the image carrying drum and does not cause environmental pollution resulting from rubbing the ear of the developer on the surface of the developing sleeve against the surface of the image carrying drum.

Still another object of the present invention is a recording apparatus having a developing unit mounting unit wherein an electrical connector for the developing unit moves together with the electrical connector in the body of the recording apparatus.

These and other objects are obtained by a recording apparatus comprising an image carrier having an image surface adapted for carrying images to be developed, a developing unit that is removably mounted in the recording apparatus and includes a developer surface adapted for carrying developer for transfer to the image surface, the developer surface being dispersed in opposition to the image surface, and means for releasably biasing the developing unit from a detached position wherein the developing unit may be removed from the recording apparatus to an operating position where developer carried by the developer surface is adapted to be transferred to images carried by the image surface.

BRIEF DESCRIPTION OF THE DRAWINGS

The manner by which the above objects, and other objects, features, and advantages of the present invention are attained will be fully apparent from the following detailed description when it is considered in view of the drawings, wherein.

DETAILED DESCRIPTION

Figure 1:
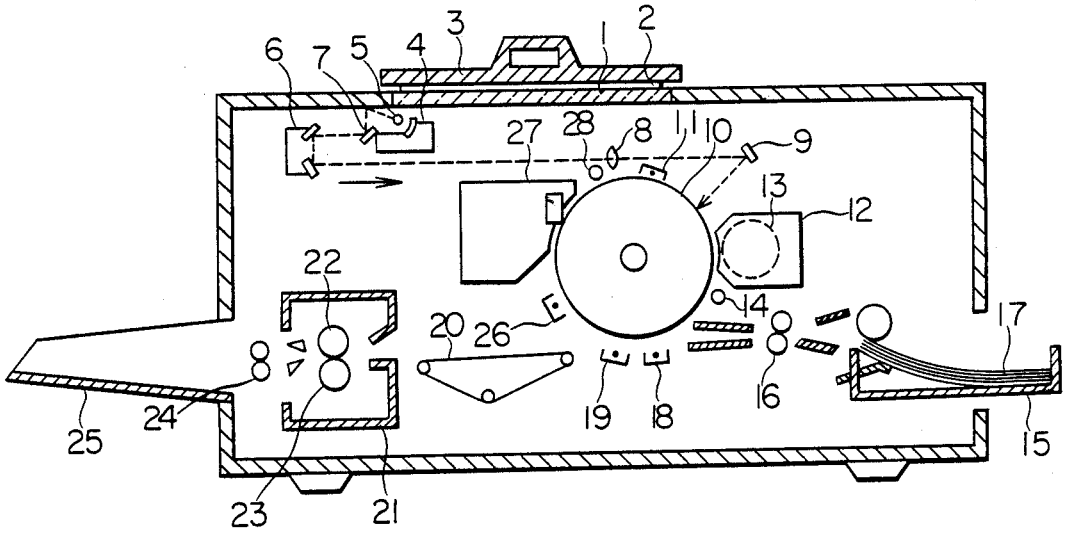
FIG. 1 is a sectional view of an electrophotographic copying machine.

FIG. 1 is a diagrammatic vertical sectional view of one embodiment of a recording apparatus according to the present invention.

As shown, an original copy 2 placed on an original table 1 having a transparent upper surface is covered by a cover 3. When a copying key is pressed, an exposure lamp 5 of an illuminating unit 4 lights up and the illuminating unit 4 moves in the direction of the arrow together with a reflecting mirror unit 6. In this manner, the lamp 5 illuminates the original copy 2. Then, as designated by the dotted line, the light applied on the original copy 2 is guided to a photosensitive drum 10 as an image carrier having an image surface through a reflecting mirror 7 of the illuminating unit 4, the reflecting mirror unit 6, an image forming lens 8, and a reflecting mirror 9. As a result, an electrostatic latent image is formed on the photosensitive drum 10 which has been charged by a charging means 11.

The electrostatic latent image is then developed to a toner image by a developing roller 13 of a developing unit 12 arranged adjacent to the surface of the photosensitive drum 10. After the charge on the photosensitive drum 10 is removed by a charge removing lamp 14, the toner image is transferred to a copying paper 17 carried from a feed cassette 15 by carrier rollers 16, by means of a transfer means 18. The copying paper 17 to which the toner image has been transferred is then separated from the photosensitive drum 10 by means of a separation means 19, carried to a fixing unit 21 by a carrier belt 20 and the toner image is fixed to the copying paper 17 by a heating roller 22 and a pressure roller 23.

The copying paper 17 after fixing is discharged into a discharge table 25 by means of a discharge roller 24. At the same time, the photosensitive drum 10 from which the copying paper 17 is separated is removed of the residual charge by means of a charge removing electrode 26. The toner remaining on the photosensitive drum 10 is cleaned by a cleaning unit 27 and the charge still remaining on the photosensitive drum 10 is removed by a charge removing lamp 28 so as to become ready for copying again.

Figure 2:
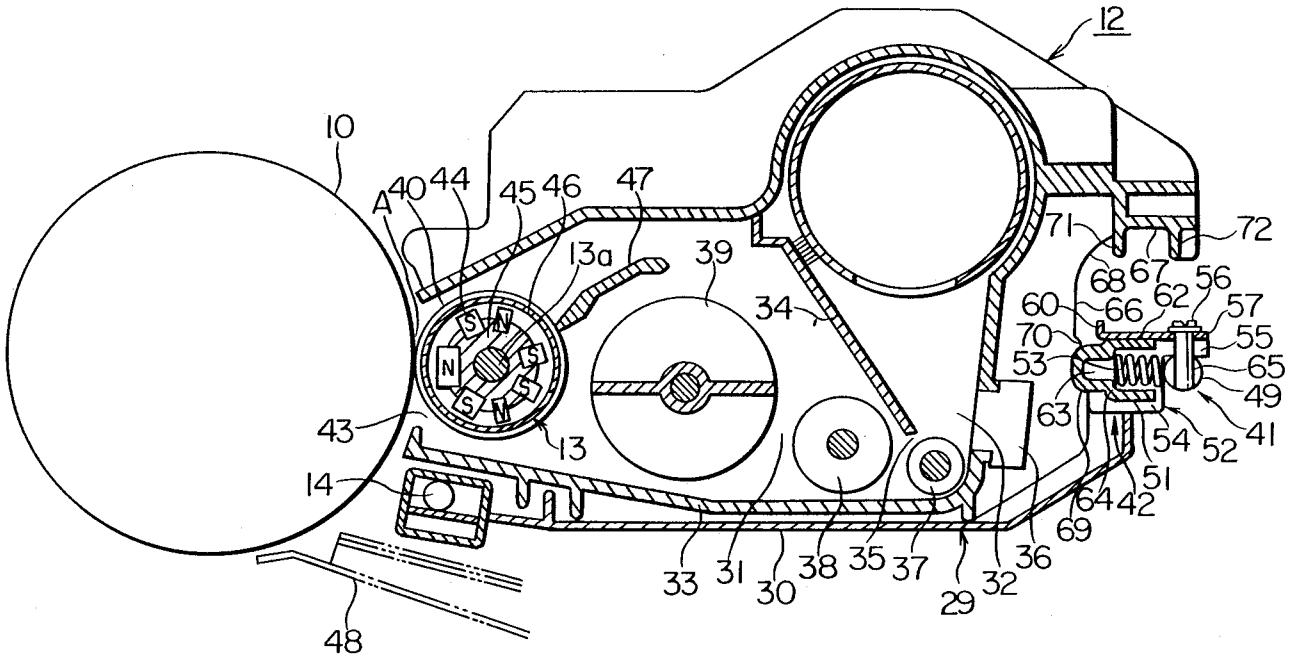
FIG. 2 is a sectional view of a developing unit mounted on the body of the electrophotographic copying machine in FIG. 1.

As shown in FIG. 2, the developing unit 12 is placed on a horizontal wall 30 of the body 29 of the copying machine at a position adjacent to the photosensitive drum 10 and is provided with a developer tank 31 and a toner supply tank 32 both of which are separated from each other at their upper parts by a partition wall 34 arranged in a casing 33 and in communication with each other at the bottoms thereof through a communication hole 35. A residual toner detector is also provided.

The toner in the toner supply tank 32 is transferred into the developer tank 31 by means of a toner supply roller 37 and a two-component developer consisting of the toner and carrier is carried to the developing roller 13 while it is agitated in sequence by a first agitating member 38 and a second agitating member 39.

Figure 3:
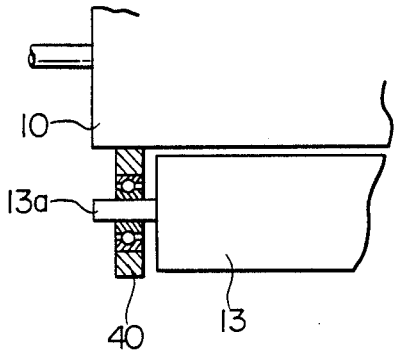
FIG. 3 is a plane view of a matching roller shown in FIG. 2.

At each end of a shaft 13*a* of the developing roller 13, there is provided a rotatable matching roller 40 (see FIG. 3), which when pressed against the photosensitive drum 10 by a pressure section 42 of mounting and dismounting unit 41 (to be described later), allows the developing roller 13 to be arranged parallel with the photosensitive drum 10 while keeping a predetermined gap from the latter. The casing 33 is provided with an opening 43 at a portion where the photosensitive drum 10 and the developing roller 13 face each other.

The developing roller 13 comprises a magnetic roller 45 having a plurality of magnets 44 arranged in the circumferential direction thereof and a rotatable hollow non-magnetic sleeve 46 surrounding the roller 45 so that the developer attracted to the outer circumference of the rotatable sleeve 46 by the magnetic roller 45 is carried to a developing zone A by the sleeve 46 while the length of the ear of the developer is regulated by an ear cutter 47. Thus, the electrostatic latent images on the photosensitive drum 10 are developed in the developing zone to form toner images. A paper feed guide 48 and a charge removing lamp 14 (before image transfer) are also provided.

Figure 4:
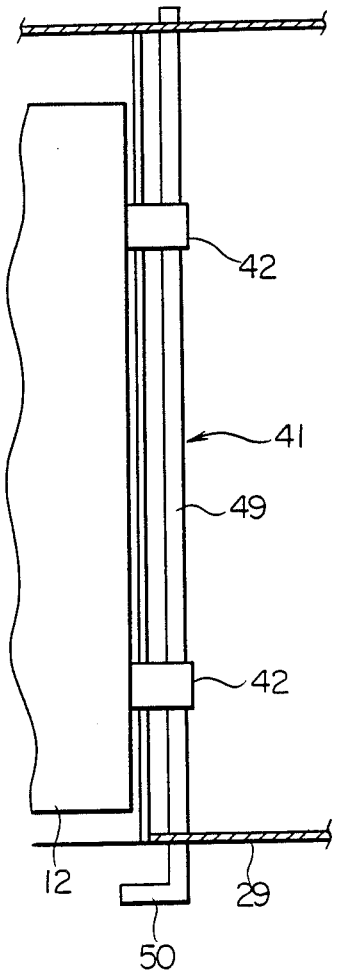
FIG. 4 is a diagrammatic plane view of a mounting and dismounting unit shown in FIG. 2.

Next, means for releasably biasing the developing unit 12 from a detached position wherein the developing unit 12 may be removed to an operating position where developer carried by the surface of the developer roller 13 may be transferred to the surface of the photosensitive drum 10 will be described. As embodied herein the biasing means comprises a mounting and dismounting unit 41 which is adapted to mount the developing unit 12 in the machine body 29 or dismount it from the latter for maintenance. This unit 41 is arranged at the end of the developing unit 12 opposite the end 43 facing the photosensitive drum 10. The dismounting unit 41 includes an operating shaft 49 that is arranged parallel to the developing roller at a position spaced from the end of the casing 33 opposite the end 43 facing the photosensitive drum 10 and rotatably supported by the machine body 29. At one end of the operating shaft 49 there is fixed an operating lever 50 (see FIG. 4) for rotating the shaft 49.

Figure 5:
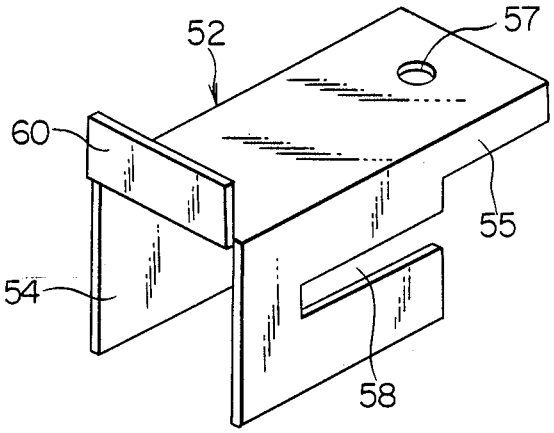
FIG. 5 is a perspective view of a retainer for a pressure member.
Figure 6:
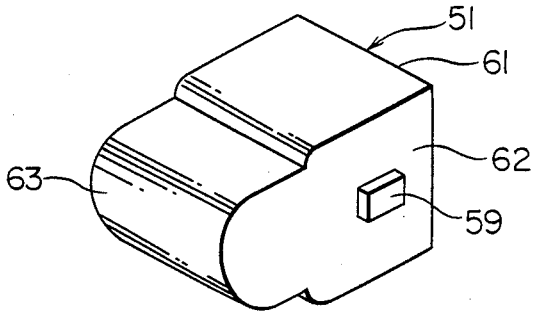
FIG. 6 is a perspective view of the pressure member shown in FIG. 2.

The operating shaft 49 is provided with engagement means connected to the operating lever 50 such that when the operating lever 50 is rotated in the counterclockwise direction the engagement means engages the developing unit 12 to an operating position and when the operating lever 50 is rotated in the clockwise direction the engagement means engages the developing 41 to move the developing unit to the detached position. As embodied herein the engagement means comprises a pair of spaced apart pressure sections 42 comprising a pressure member 51, a retainer 52 for supporting the member 51, and a spring 53 for energizing the member 51. The retainer 52 (see FIG. 5) is formed such that both side walls of the rear part of a reversed U-shaped piece are cut from the bottom toward the upper part of the piece so that a housing section 54 for receiving the pressure member 51 is formed at the front half of the piece. A mounting section 55 for mounting the operating shaft 49 is formed at the rear half thereof. A throughhole 57 is formed at the center of the upper wall of the mounting section 55 so as to insert a screw 56 thereinto, and grooves 58 each extending from the rear end toward the front end of the piece in parallel relationship with the upper wall are formed in both side walls of the housing section 54 at a height half that of the walls so as to receive a projection 59 (see FIG. 6) of the pressure member 51 to be described later. Further, there is provided a stopper 60 extending upright from the upper wall of the front end of the housing section 54.

The pressure member 51 (see FIG. 6) is in the shape of a box with one of its sides held open, as at 61, and the rear part of the member forms a rectangular spring receiving section 62 while the front half thereof forms a U-shaped pressure portion 63. The vertical width of the U-shaped pressure portion 63 is smaller than that of the rectangular spring receiving section 62 so that a seat 64 for the spring is formed at the stepped portion where the portion 63 is continuous with the section 62. The spring receiving section 62 is provided with the projections 59 on the outer surfaces of both side walls thereof which projections fit in the grooves 58 of the retainer 52 so that the pressure member 51 is retained by the retainer 52 and moves along the grooves 58. Accordingly, the retainer 52 may be fixed to the operating shaft 49 in such a manner that the mounting section 55 of the retainer 52 is placed on the operating shaft 49, the screw 56 is inserted into the throughhole 57 and then into a tapped hole 65 of the operating shaft 49 to thereby fix the retainer 52 to the operating shaft 49. The pressure member 51 is received into the pressure member housing section 54 of the retainer 52 and the projections 59 of the pressure member 51 are inserted into the grooves 58 of the side walls of the retainer 52 so as to be removably retained within the receiving section along the grooves 58. The spring 53 is received within the spring receiving section 62 of the pressure member 51 with one end thereof engaging the side surface of the operating shaft 49 while the other end engages the spring seat 64 of the member 51 to urge the member 51 toward its projecting direction.

At the end of the casing 33 opposite to the side facing the photosensitive drum 10 of the developing unit 12, there are provided a vertical wall 66 with which the pressure member 51 is engageable, a horizontal wall 67 above the member 51 and a circular, arc-shaped wall 68 connecting the walls 66 and 67 at a moderate slope. The vertical wall 66 has a stepped portion 69 against which the pressure portion 63 of the pressure member 51 abuts to prevent the downward movement of the pressure member 51. Further, at the vertical wall 66 a little higher than the stepped portion 69, there is a projection 70 in the shape of a gently sloping circular arc which is brought into engagement with the pressure portion 63 of the pressure member 51 so that the pressure member is prevented from moving upward unless a predetermined external force is applied thereon.

The horizontal wall 67 is provided with a pair of first and second projections 71 and 72 extending from the operating shaft 49 in the normal direction. The second projection 72 at one end of the casing 33 is brought into engagement with the pressure portion 63 of the pressure member 51 to move the developing unit 12 horizontally on the machine body 29 in the direction normal to the shaft of the photosensitive drum 10 to a detached position when the pressure member 51 is rotated clockwise while the projection 71 is brought into engagement with the pressure portion 63 of the pressure member to move the developing unit 12 in the direction of the photosensitive drum 10 to an operating position when the pressure member 51 is rotated counter-clockwise.

The operation of the mounting and dismounting unit 41 of the developing unit 12 will be described.

FIG. 2 shows a state in which the developing unit 12 is mounted on the machine body 29. The developing unit 12 is biased by the pressure member 51 of the pressure section 42 of the mounting and dismounting unit so that the matching roller of the developing unit 12 is pressed against the photosensitive drum 10 and a predetermined gap is kept between the drum 10 and the developing roller 13. To remove the developing unit 12 from the machine body 29 for maintenance, the operating lever 50 is first rotated in the clockwise direction whereupon the operating shaft 49 rotates clockwise together with the lever 50 and at the same time, the pressure member 51 rotates in the same direction. In this case, the pressure portion 63 of the pressure member 51 goes beyond the projection 70 of the vertical wall 66 of the casing 33 of the developing unit 12 due to the contraction of the spring 53 and engages the projection 72 of the vertical wall 67. Thus, with the pressure portion 63 in engagement with the projection 72, when the stopper 60 of the retainer 52 is rotated until it comes to engage the machine body 29, the developing unit 12 moves horizontally on the horizontal wall 30 of the machine body 29 in the direction normal to the axis of the photosensitive drum 10 and the matching roller 40 of the developing unit 12 is separated from the drum 10 leaving a predetermined gap from the latter. In this state or detached position, when the developing unit 12 is drawn toward this side in parallel relationship with the shaft of the photosensitive drum 10, the matching roller 40 of the developing unit 12 may be removed from the machine body 29 without contacting the surface of the drum 10, that is, without damaging the surface of the drum.

Next, in case the developing unit 12 is mounted on the machine body 29, the developing unit 12 is inserted over the horizontal wall 30 of the machine frame 29 in parallel relationship with the axis of the photosensitive drum 10 from the front opening of the developing unit in a state in which the stopper 60 of the retainer 52 of the mounting and dismounting unit 41 has risen to engage the machine body 29. After insertion, the operating lever 50 is rotated counter-clockwise whereupon the operating shaft 49 rotates counter-clockwise by the action of the operating lever 50 and the pressure member 51 rotates counter-clockwise together with the operating shaft 49. Thus, with the rotation of the pressure member 51, the pressure portion 63 of the pressure member 51 comes to engage the first projection 71 of the horizontal wall 6 of the casing 33 of the developing unit 12. When the pressure member 51 is further rotated counter-clockwise with the pressure portion 63 engaging the first projection 71, the developing unit 12 moves horizontally on the horizontal wall 30 of the machine body 29 toward the photosensitive drum 10. Then the pressure portion 63 moves away from the first projection 71 to engage the vertical wall 66 of the casing 33 and when the portion 63 is rotated until it goes beyond the projection 70 of the vertical wall 66, the pressure member 51, as biased by the spring 53 biases the developing unit to cause the matching roller 40 to be pressed against the photosensitive drum 10 so that the drum 10 and the developing roller 13 are located close to each other in the operating position with a predetermined gap therebetween and the pressure member 51 is retained between the stepped portion 69 of the vertical wall 66 and the projection 70.

As described, it is possible with the present invention to mount and dismount the developing unit on, and from, the recording apparatus without damaging the image carrier.

That is, in case the developing unit is removed from the recording apparatus, when the operating lever is rotated, the operating shaft rotates and so the energizing means fixed to the shaft rotates to move away from the end of the casing of the developing unit so that the pressure urging the developing unit against the end of the casing is released. Consequently, to remove the developing unit, the developing unit is moved on the recording apparatus in the direction normal to the axis of the image carrier so as to become separated from the image carrier and then taken out from the recording apparatus in parallel relationship with the axis of the image carrier. On the other hand, to mount the developing unit on the recording apparatus, the developing unit is inserted into the recording apparatus in parallel relationship with the axis of the image carrier after it is separated from the image carrier. Then, when the operating lever is rotated counter-clockwise, the operating shaft also rotates together with the energizing means fixed thereto so that the energizing means biases the end of the casing of the developing unit to move the unit toward the image carrier thereby fixing the unit to the image carrier.

Figure 7:
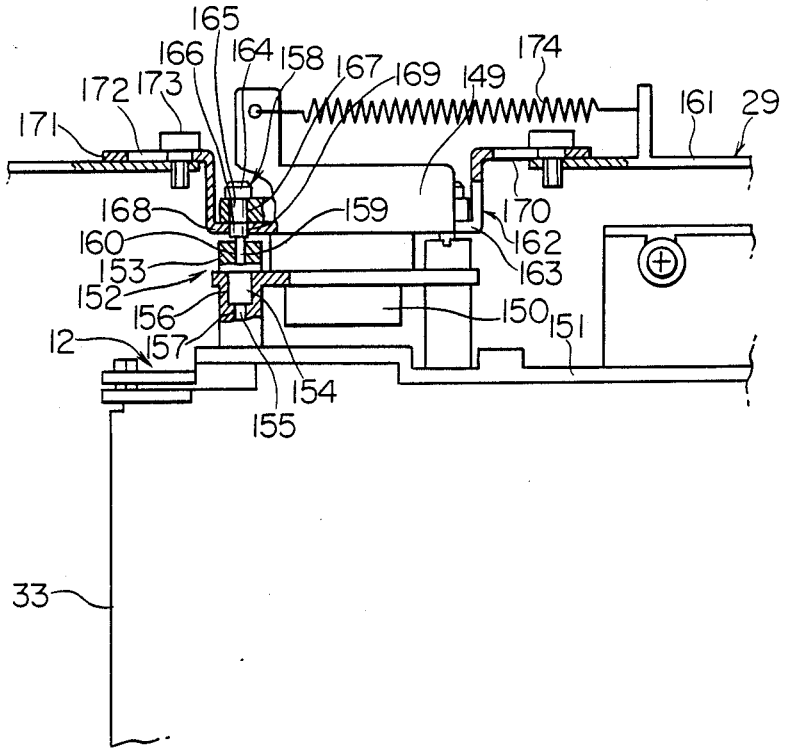
FIG. 7 is a plane view partially in section of a connector portion between the developing unit and the body of the copying machine.

According to the present invention, a connector 150 is provided on the outer surface of the rear side wall 151 of the casing 33 of the developing unit 12 as shown in FIG. 7. This connector is adapted to connect to a connector 149 on the machine body 29 for the purpose of supplying a developing bias voltage on the developing unit 12 and is moved horizontally on the vertical wall 30 of the machine body 29 in the direction normal to the axis of the photosensitive drum 10 at the time of mounting or dismounting the developing unit 12 as already described. The connector 149 and the connector 150 must be moved together with the developing unit 12. Therefore, the recording apparatus further comprises the following.

The connector 150 of the developing unit 12 is fixed to the outer surface of the rear side wall 151 of the casing 33 of the developing unit 12. There is fixed to the surface of the connector 150 opposing the connector 149 of the machine body, a pair of positioning bolts 152. Each positioning bolt 152 includes a head 153, a large-diametered portion 154, and a tapped portion 155. The large-diametered portion 154 fits in a concave section 156 formed in the surface of the connector 150 of the developing unit 12 opposing the connector 149 of the machine body, the tapped portion 155 is screwed into a tapped hole 157 formed below the concave section 156 so that the bolt 152 is fixed to the connector 150. Further, in the surface of the head 153 of the positioning bolt 152 facing the connector 149 of the machine body, there is provided a pin hole 160 for receiving a positioning pin 159 of a fixing bolt 158 to be described later. The connector 149 of the machine body to which the connector 150 of the developing unit 12 is connected is attached to the side wall 161 of the machine body 29 so as to move in the direction of the developing unit 12 when the unit 12 moves between the operating position and the detached position.

The connector 149 is fixed to an intermediate concave portion 163 of a mounting plate 162 by means of the fixing bolts 158 mentioned above. The fixing bolt 158 includes a head 164, a large-diametered portion 165, a tapped portion 166, and a positioning pin 159. The large-diametered portion 165 fits in a throughhole 167 formed in the connector 149 and the tapped portion 166 is screwed into a tapped hole 169 in the bottom wall 168 of the concave portion 163 of the mounting plate 162 thereby fixing the connector 149 to the mounting plate 162 with the positioning pin 159 projecting from the bottom wall 168.

The concave portion 163 fixed with the connector 149 is arranged in a notched portion 170 formed in the side wall 161 of the machine body 29 and mounting plates 171 on both sides of the concave portion 163 are attached to the portions of the side wall 161 on both sides of the notched portion 170. The mounting plate 171 is provided with an elongated hole 172 through which a bolt 173 is inserted to fix the mounting plate to the wall 161 of the machine body. In this case, the bolt 173 is fastened such that the gap between the bottom surface of the head thereof and the outer surface of the wall 161 is somewhat larger than the thickness of the mounting plate 171. Further, between the connector 149 and the side wall 161 of the machine body there is attached a spring 174.

The operation of the connector portion of the time when the developing unit 12 is mounted in, or dismounted from, the machine body will be described.

FIG. 7 shows a state in which the developing unit is mounted in the machine body. When the developing unit 12 is moved on the horizontal wall 30 of the machine body 29 in the direction normal to the axis of the photosensitive drum 10, the connector 150 of the developing unit 12 moves in the same direction. In this case, the connector 149 of the machine body 29 connected to the connector 150 of the developing unit 12 also moves together with the connector 150 as the mounting plate 162 moves on the wall 161 of the machine body along the elongated hole 172. Then, when the developing unit 12 is drawn out from this side along the horizontal wall 30 of the machine body 29, the connector 150 of the developing unit 12 is disconnected from the connector 149 of the machine body 29 allowing the unit 12 to be taken out from the machine body, so that the connector 149 is disconnected from the connector 150 and is held at its fixed position. Next, in case the developing unit 12 is mounted in the machine body 29, when the unit 12 is inserted into the machine body in parallel with the photosensitive drum 10 on the horizontal wall of the body, the pin hole 160 of the connector 150 of the developing unit 12 mates with the pin 159 of the connector 149 to connect both of the connectors 149 and 150. Thus, when the developing unit 12 is moved on the horizontal wall 30 of the machine body 29 toward the photosensitive drum 10, the connector 150 of the developing unit 12 moves in the same direction together with the connector 149 due to the movement of the mounting plate 162 on the side wall 161 of the machine body along the elongated hole 72.

As described above, when the developing unit moves, the connector of the recording apparatus moves together with the connector of the developing unit and when the connector of the developing unit is removed from the recording apparatus, the connector of the recording apparatus is held at its fixed position by the action of the spring 174. Accordingly, by inserting the developing unit into the recording apparatus always at the fixed position, it is possible to connect the connector of the developing unit to that of the recording apparatus.

Another embodiment of the present invention shown in FIGS. 8 through 10 will now be described in detail.

The embodiment illustrates cases in which developing unit B is detachably mounted in a machine frame 202 having an image carrying drum 201 mounted therein. The frame 202 in this case is provided with a mounting window 203 confronting the image carrying drum 201. In the machine frame 202 there is provided a guide rail 204 which extends across the bottom of the mounting window 203 in the longitudinal direction of the image carrying drum 201 and the developing unit B is attached to the the machine frame along the guide rail.

The developing unit B has a casing B1 storing a developer X therein and agitating wings 205 for performing frictional electrification by mixing the developer X is arranged at the center of the casing B1. Therefore, the developer X charged with electricity by the agitating wings 205 is magnetically attracted to the peripheral surface of a developing sleeve 207 incorporating a plurality of permanent magnets 206 therein and is carried to the image carrying drum 201. Further, at the upper part of the developing sleeve 207 there is provided a doctor blade 208 so that the ear of the developer X on the developing sleeve is made uniform in thickness by the doctor blade 208 and is supplied to the peripheral surface of the image carrying drum 201 thereby developing the electrostatic image formed on the drum.

Figure 8:
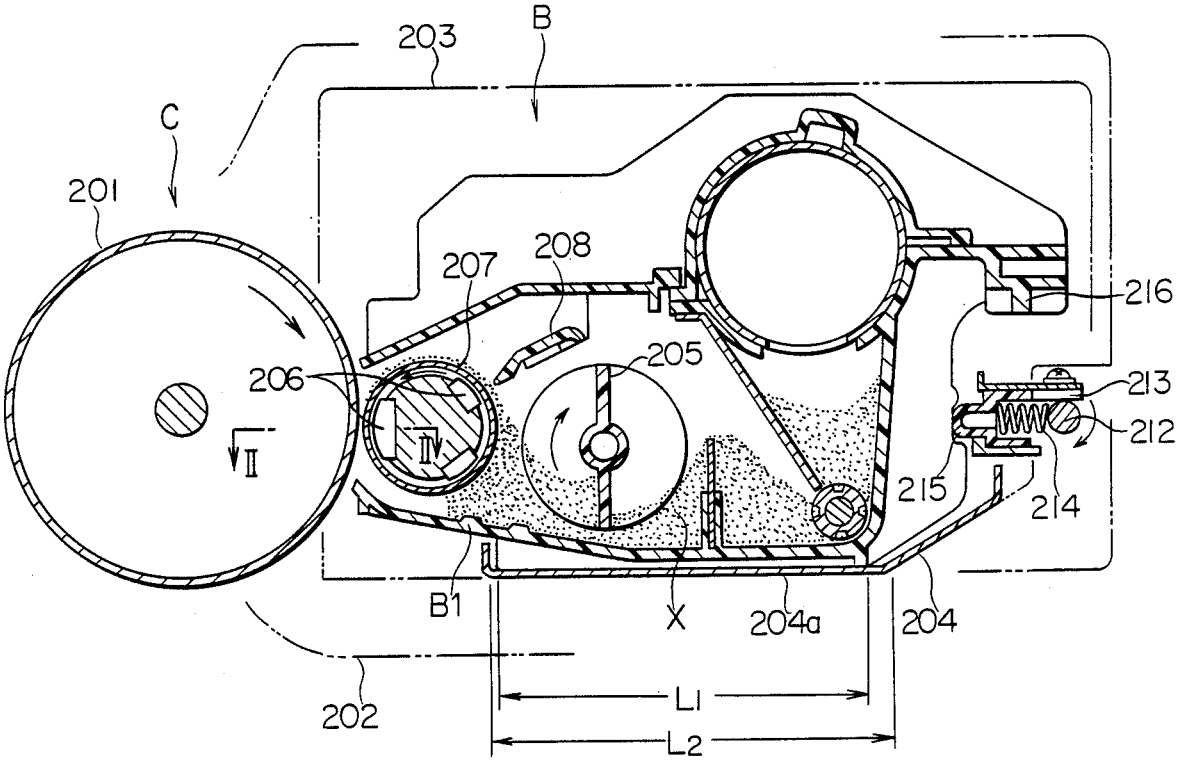
FIG. 8 is a sectional view showing a developing unit according to another embodiment of the present invention.

The matching rollers, corresponding with the reference numeral 40 in FIG. 2, for maintaining the predetermined gap between the image carrying drum 201 and the developing sleeve 207 are not shown in FIG. 8 in order to indicate the developer layer formed on the developing sleeve 207.

The developing unit B is movable slightly on the guide rail 204 in the horizontal direction because the size L1 of the leg of the casing B1 is made smaller than the size L2 of the horizontal section 204*a* of the guide rail so that the unit B can move horizontally by a distance corresponding to the difference between the sizes L1 and L2. Further, as shown in FIG. 9, the casing B1 has a projection 209*a* on the end wall 209 thereof so that when the developing unit B is completely incorporated with the machine frame 209, the projection 209*a* is positioned to overlap a part of the image carrying unit C in the longitudinal direction of the image carrying drum 201. In the case of the embodiment shown in FIG. 9, the projection 209*a* is interposed in the gap 211 between the end face of the image carrying drum 201 and a unit cover 210 so that unless the projection 209*a* is drawn out from the gap 211 to the right when viewed from FIG. 8, neither the image carrying unit C nor the developing unit B can be removed in the longitudinal direction.

Further, at a position opposite the image carrying drum 201, there is arranged an operating shaft 212 which can be operated by a manual operating lever (not shown) and at the intermediate portion of the operating shaft 212, there is supported a pusher 215 held pressed against a stationary member 213 by a spring 214. The pusher 215 biases the developing unit B to the operating position of the developing unit by the action of the spring 214 but when the operating shaft 212 is rotated clockwise from the state shown in FIG. 8, it removes the developing unit B from the image carrying drum 1 by engaging an engaging section 216 at the right end of the casing.

Figure 9:
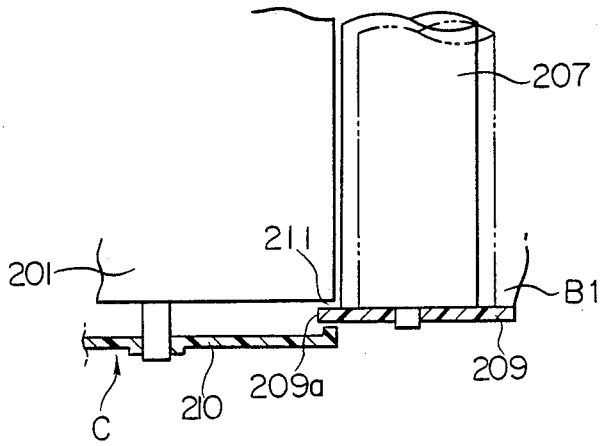
FIG. 9 is a sectional view taken along the line II—II of FIG. 8.

With the above structures, in the cases of FIGS. 8 and 9, when the image carrying drum 201 and the developing unit B are completely assembled with the machine frame 202, the developing unit B and the pusher are positioned as shown in FIG. 8. That is, they are in such state that the developing unit B is biased toward the left so that a predetermined clearance is formed between the outer periphery of the image carrying drum 201 and that of the developing sleeve 207 and at the same time, the projection 209*a* of the casing B1 fits into the clearance 211 (See FIG. 9). Consequently, in the above assembled state, the relative movement of the image carrying unit C or the developing unit B in the normal direction, that is, the removal of the unit C or B is prevented due to the insertion of the projection 209*a* into the clearance 211 and as a result, it is possible to prevent the peripheral surface of the image carrying drum 201 from being damaged due to friction at the time of its removal and also to prevent the developer X from dropping outside the machine.

Figure 10:
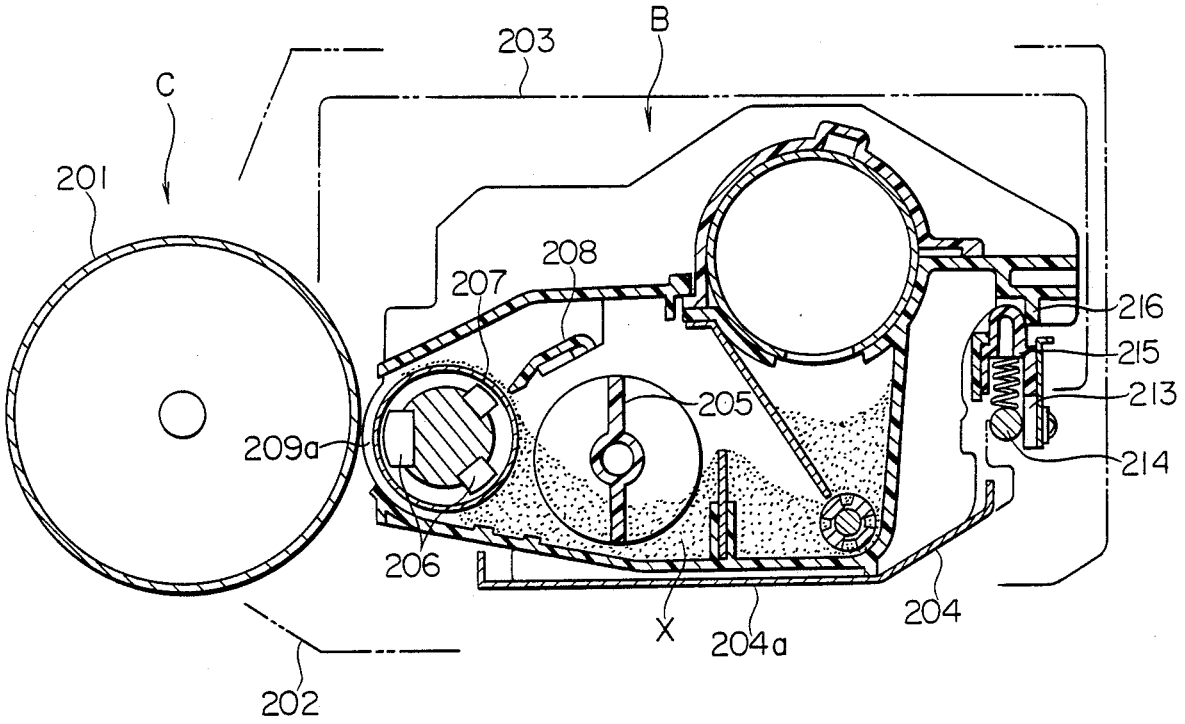
FIG. 10 is a sectional view similar to FIG. 8, when the developing unit is dismounted.

Further, in order to remove the image carrying unit C or the developing unit B from the machine frame 202, the operating shaft 212 may be rotated clockwise manually because, by so doing, the pusher 215 comes to engage the engaging section 216 of the casing B1 as shown in FIG. 10 and with further rotation of the operating shaft 212 in the clockwise direction, the developing unit B moves to the right along the horizontal wall 204*a* of the guide rail 204. Therefore, the peripheral surface of the developing sleeve 207 of the developing unit 8 moves away from the peripheral surface of the image carrying drum 201 to the sufficient degree (See FIG. 10) and in that state the projection 209*a* goes out from the clearance 211 as designated by the hypothetical line in FIG. 9. As a result, it becomes possible to remove the developing unit B or the image carrying unit C from the machine frame 202 by moving it in the direction parallel with the axis of the image carrying drum 201 with the advantages that the peripheral surface of the image carrying drum 201 is free from flaws and the dropping of the developer X is prevented due to the sufficient clearance between the peripheral surface of the drum 201 and that of the developing sleeve 207. Needless to say, when the image carrying unit C or the developing unit B is re-assembled, if the developing unit B is moved along the guide rail 204 to realize the state shown in FIG. 10 and then the operating shaft 212 is rotated in the counter-clockwise direction, the assembled state shown in FIG. 8 will be realized.

As will be clear from the foregoing description, the present invention is advantageous in that when the image carrying unit and the developing unit are assembled with the machine body, a part of the developing unit is caused to overlap the image carrying unit so that the relative movement of the developing unit with respect to the longitudinal direction of the image carrying drum and accordingly, the dropping of the developer and the damage of the image carrying unit at the time of removal of the developing unit from the machine body are prevented and further that because of the structure that the developing unit is drawn out in the longitudinal direction of the image carrying drum, the assembly of the apparatus at the time of manufacture and maintenance and control of the apparatus are facilitated.

what is claimed is:

1. A recording apparatus comprising:

an image carrier having a movable image surface adapted for carrying a latent image to be developed, said image carrier including a drum extending in a longitudinal direction;

a developing unit having a developer surface for conveying a developer thereon, guide means including a wall for slidably mounting said developing unit thereon, means for releasably biasing said developing unit for slidably moving said developing unit in a biasing direction between at least a first position and a second position, said first position being an operating position where said developer surface faces said movable image surface with a development gap therebetween to transfer the developer onto the movable image surface and the second position is a detached position where said developer surface is spaced from said movable image surface with a gap larger than the development gap, said developing unit including an end wall part overlapping a portion of said image carrier when said developing unit is in said operating position to prevent movement of said developing unit in said longitudinal direction; and said guide means further allowing said developing unit to slide on said wall in a mounting direction transverse to the biasing direction, said developing unit being slidable on said guide means in said mounting direction for mounting said developing unit in the recording apparatus and then movable in said biasing direction for positioning in said operating position.

2. A recording apparatus according to claim 1, wherein said biasing means comprises:

an operating lever rotatable in a first direction and in a second direction opposite to said first direction; and engagement means connected to said operating lever such that when said operating lever is rotated in said first direction said engagement means engages said developing unit to bias said developing unit to said operating position and when said operating lever is rotated in said second direction said engagement means engages said developing unit to move said developing unit to said detached position.

3. A recording apparatus according to claim 2, wherein said engagement means comprises an operating shaft connected to said operating lever, a retainer fixed to said operating shaft, a pressure member being slidably provided in said retainer and adapted to bias said developing unit when said operating lever is rotated in said first direction, and a spring for urging said pressure member in a direction in which the pressure member is slidable against said retainer.

4. A recording apparatus according to claim 1 further comprising:

a first connector means provided on said developing unit; and a second connector means slidably mounted in the recording apparatus for movement between a first position corresponding to said detached position and a second position corresponding to said operating position, said second connector for electrically engaging said first connector when said developing unit is in said detached position and for moving between said first position and said second position in electrical engagement with said first connector as said developing unit is moved between said detached position and said operating position.

5. A recording apparatus according to claim 4, further including spring means connected to said second connector means to normally urge said second connector means to said first position for engaging said first connector means when said developing unit is in said detached position.

6. A recording apparatus according to claim 5, wherein said spring means comprises a spring having a first end connected to the recording apparatus and a second end connected to said second connector means.

7. A recording apparatus according to claim 4, wherein said developing unit comprises a developing roller having said developer surface and means for applying a bias voltage to said developing roller through said first and second connector means.

8. A recording apparatus according to claim 1, wherein said developing unit comprises a developing roller having said developer surface and a matching roller concentric with said developing roller and having a radius exceeding the radius of said developing roller by an amount corresponding to a predetermined spacing between said image surface and said developer surface when said developing unit is in said operating position, said matching roller for engaging said image carrier when said developing unit is in said operating position to maintain said predetermined spacing between said image surface and said developer surface.

9. A recording apparatus according to claim 8, wherein said matching roller is rotatable.

10. A recording apparatus according to claim 8, wherein said developing unit further comprises a second matching roller concentric with said developing roller and having a radius equal to the radius of said first-mentioned matching roller and said developer surface being between said first-mentioned matching roller and said second matching roller.

11. A recording apparatus according to claim 10, wherein said first and second matching rollers are rotatable.

12. A recording apparatus according to claim 1, further including an end plate for supporting said image carrier and for overlapping a portion of said end wall part of said developing unit.

* * * * *